US007883124B2

(12) United States Patent
Gephart et al.

(10) Patent No.: US 7,883,124 B2
(45) Date of Patent: Feb. 8, 2011

(54) GATE LATCH

(75) Inventors: John D. Gephart, Rocky Hill, CT (US); Kenneth Strickland, South Glastonbury, CT (US)

(73) Assignee: National Manufacturing Co., Sterling, IL (US)

( * ) Notice: Subject to any disclaimer, the term of this patent is extended or adjusted under 35 U.S.C. 154(b) by 930 days.

(21) Appl. No.: 11/121,182

(22) Filed: May 4, 2005

(65) Prior Publication Data

US 2006/0248979 A1 Nov. 9, 2006

(51) Int. Cl.
*E05C 3/04* (2006.01)

(52) U.S. Cl. ..... 292/210; 292/205

(58) Field of Classification Search ..... 292/210, 292/238, 202, 203, 205, 304; 49/394, 166
See application file for complete search history.

(56) References Cited

U.S. PATENT DOCUMENTS

| | | | | | |
|---|---|---|---|---|---|
| 103,586 | A | | 5/1870 | Dolan | |
| 284,336 | A | | 9/1883 | Scranton | |
| 481,910 | A | | 8/1892 | Monroe | |
| 577,818 | A | | 2/1897 | Cronk | |
| 751,495 | A | * | 2/1904 | Gauchet | 292/57 |
| 811,880 | A | | 2/1906 | Steensland et al. | |
| 903,685 | A | * | 11/1908 | Canio | 292/205 |
| 1,014,290 | A | | 1/1912 | Frantz | |
| 1,490,694 | A | * | 4/1924 | Brabson | 292/218 |
| 1,539,173 | A | * | 5/1925 | Fairbank | 292/214 |
| 1,812,334 | A | * | 6/1931 | Gloekler | 292/205 |
| 2,074,759 | A | * | 3/1937 | Richards | 292/68 |
| 2,196,478 | A | * | 4/1940 | Simpson | 292/210 |
| 2,644,708 | A | | 7/1953 | Poole | |
| 2,794,663 | A | | 6/1957 | Grodt et al. | |
| 3,266,831 | A | * | 8/1966 | Banse | 292/133 |
| 3,514,820 | A | * | 6/1970 | Rogg | 24/580.1 |
| 3,715,531 | A | * | 2/1973 | Keeley | 200/19.39 |
| 3,979,144 | A | * | 9/1976 | Bascou | 292/216 |
| 4,062,575 | A | | 12/1977 | Robins | |
| 4,111,476 | A | * | 9/1978 | Jacobs | 292/246 |
| 4,142,750 | A | * | 3/1979 | Kagoura | 292/210 |
| 4,179,144 | A | * | 12/1979 | Henderson | 292/202 |
| 4,305,611 | A | | 12/1981 | Robins | |
| 4,391,461 | A | * | 7/1983 | Deibele | 292/204 |
| 4,451,072 | A | * | 5/1984 | Petty, Sr. | 292/128 |
| 4,580,822 | A | * | 4/1986 | Fukumoto | 292/336.3 |
| 4,684,159 | A | * | 8/1987 | Hutter | 292/268 |
| 4,727,301 | A | * | 2/1988 | Fulks et al. | 318/468 |
| 4,778,207 | A | * | 10/1988 | Gergoe | 292/336.3 |

(Continued)

*Primary Examiner*—Gary Estremsky
(74) *Attorney, Agent, or Firm*—Pillsbury Winthrop Shaw Pittman LLP

(57) ABSTRACT

A gate latch includes a bracket that has flanges with a plurality of holes for receiving fasteners that enable the bracket to be mounted to a bracket mounting surface. The bracket has a raised portion joined with the flanges and cooperates with the bracket mounting surface to define a space therebetween. The latch also includes a latch arm having an end portion thereof pivotally joined with the raised portion and capable of limited pivotal movement relative to the bracket. The latch arm is received in the space between the raised portion and the mounting surface when the bracket is secured to the mounting surface. The latch further includes a catch to be mounted to a catch mounting surface adjacent to the bracket and the latch arm. The catch includes a latch arm receiving region and a movable lock.

12 Claims, 7 Drawing Sheets

U.S. PATENT DOCUMENTS 5,358,292 A 10/1994 Van Wiebe et al.
5,452,544 A * 9/1995 Weathington, Sr. ..... 49/394
5,498,041 A * 3/1996 Bezzerides et al. ..... 292/225
5,511,385 A * 4/1996 Drew et al. ..... 62/172
5,720,082 A 2/1998 Rossmo
5,794,994 A * 8/1998 Miyagawa et al. ..... 292/336.3
5,799,990 A * 9/1998 Hardee ..... 292/238
5,868,446 A 2/1999 Rossmo
6,058,747 A 5/2000 Doyle et al.
6,550,825 B2 * 4/2003 Ostrowski et al. ..... 292/199
6,679,530 B2 * 1/2004 Krynski ..... 292/210
6,752,438 B2 6/2004 DeSouza
7,152,893 B2 * 12/2006 Pudney ..... 292/336.3
7,255,375 B2 * 8/2007 Heid et al. ..... 292/95
2002/0145289 A1 * 10/2002 Cole et al. ..... 292/58
2006/0006669 A1 * 1/2006 Nelsen et al. ..... 292/216

* cited by examiner

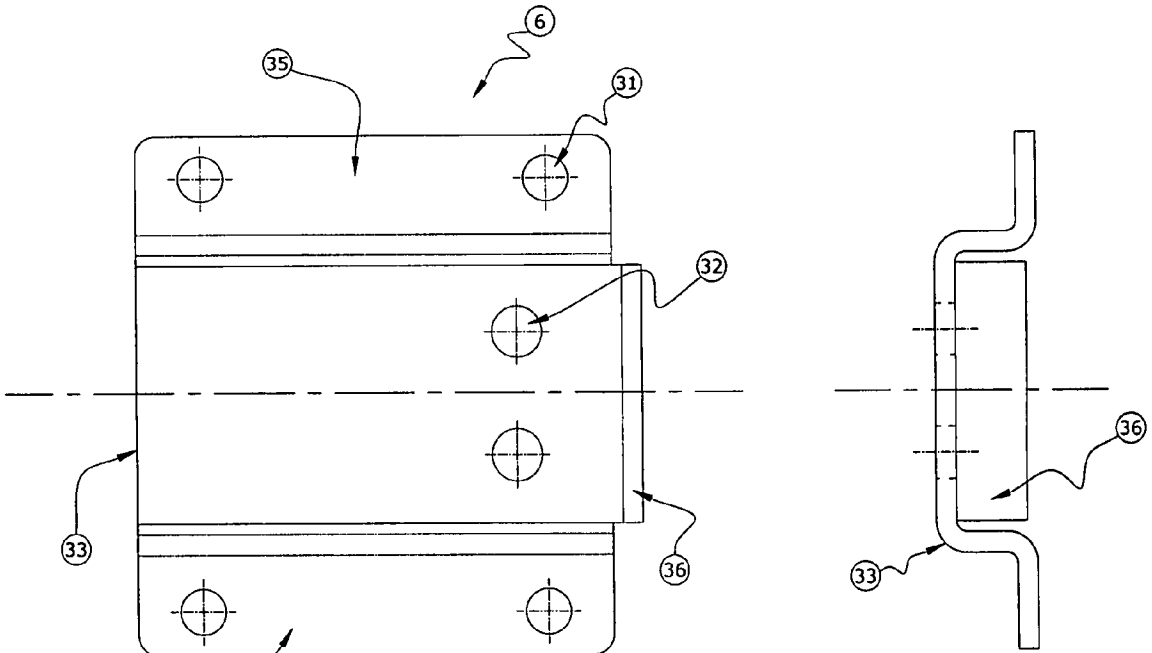
FIG. 3a
FIG. 3c
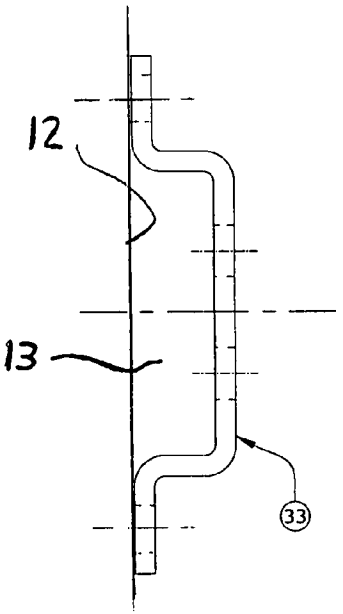
FIG. 3b
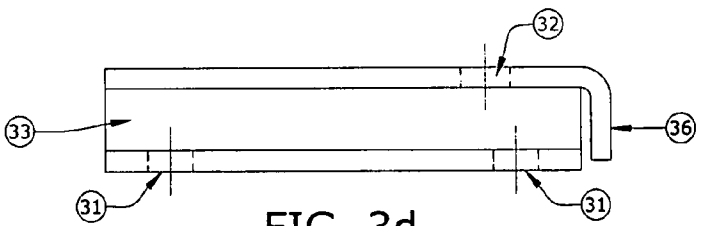
FIG. 3d
FIG. 3

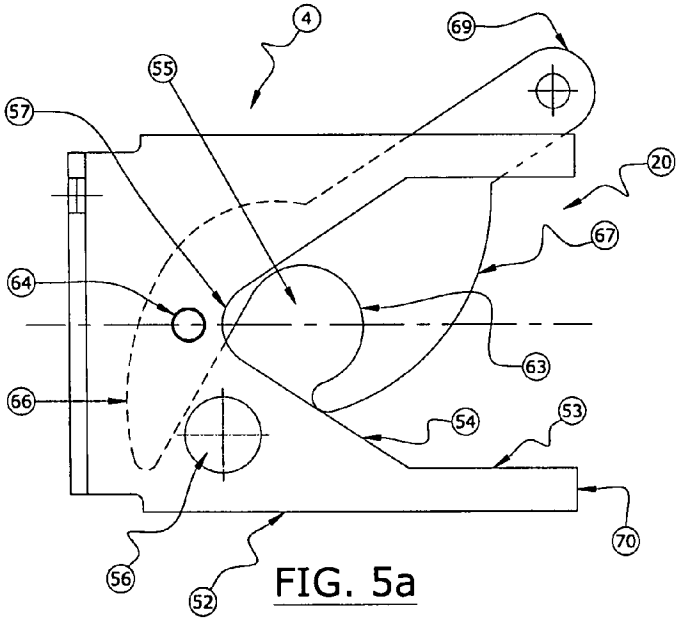
FIG. 5a
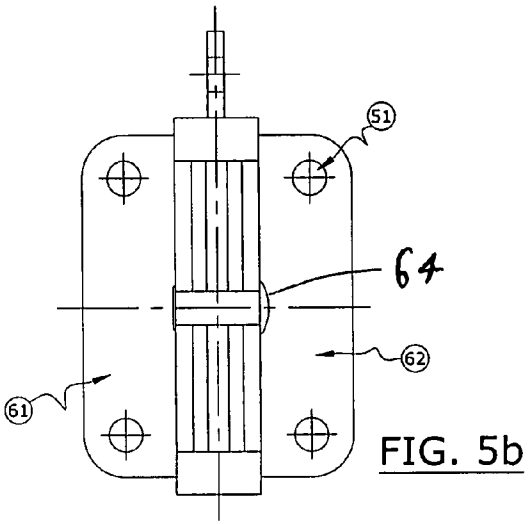
FIG. 5b
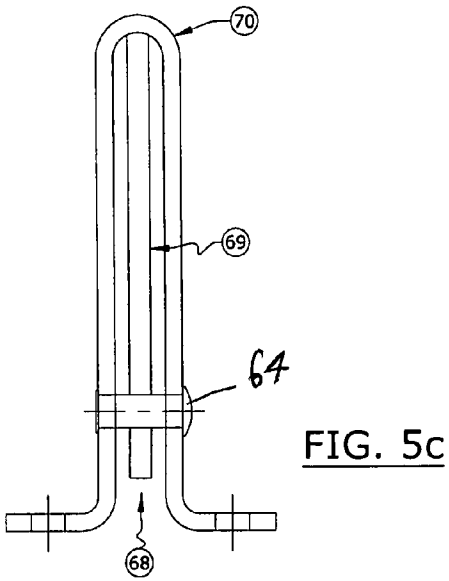
FIG. 5c
FIG. 5

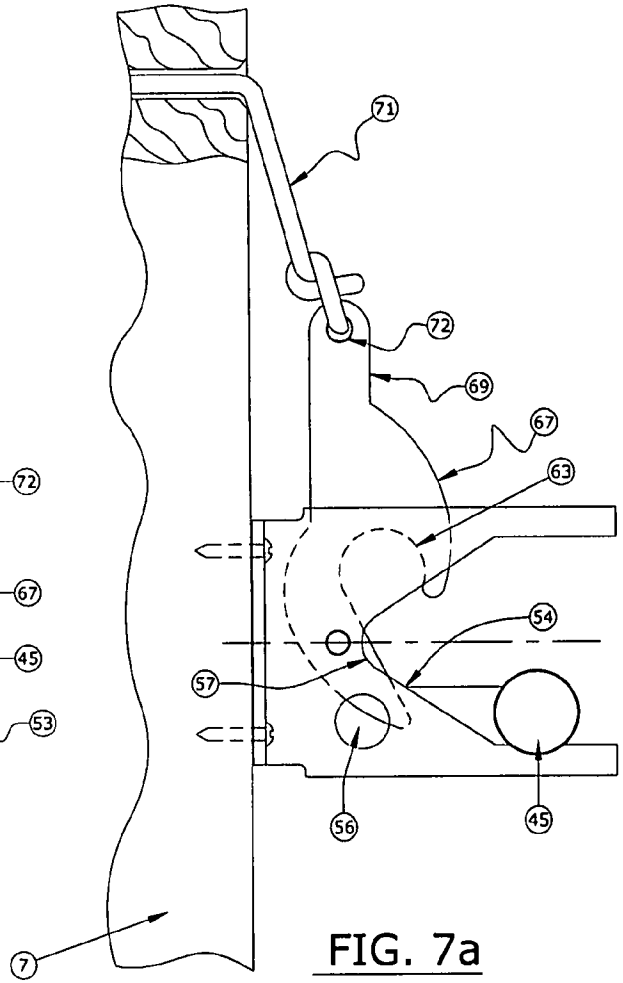
FIG. 7a
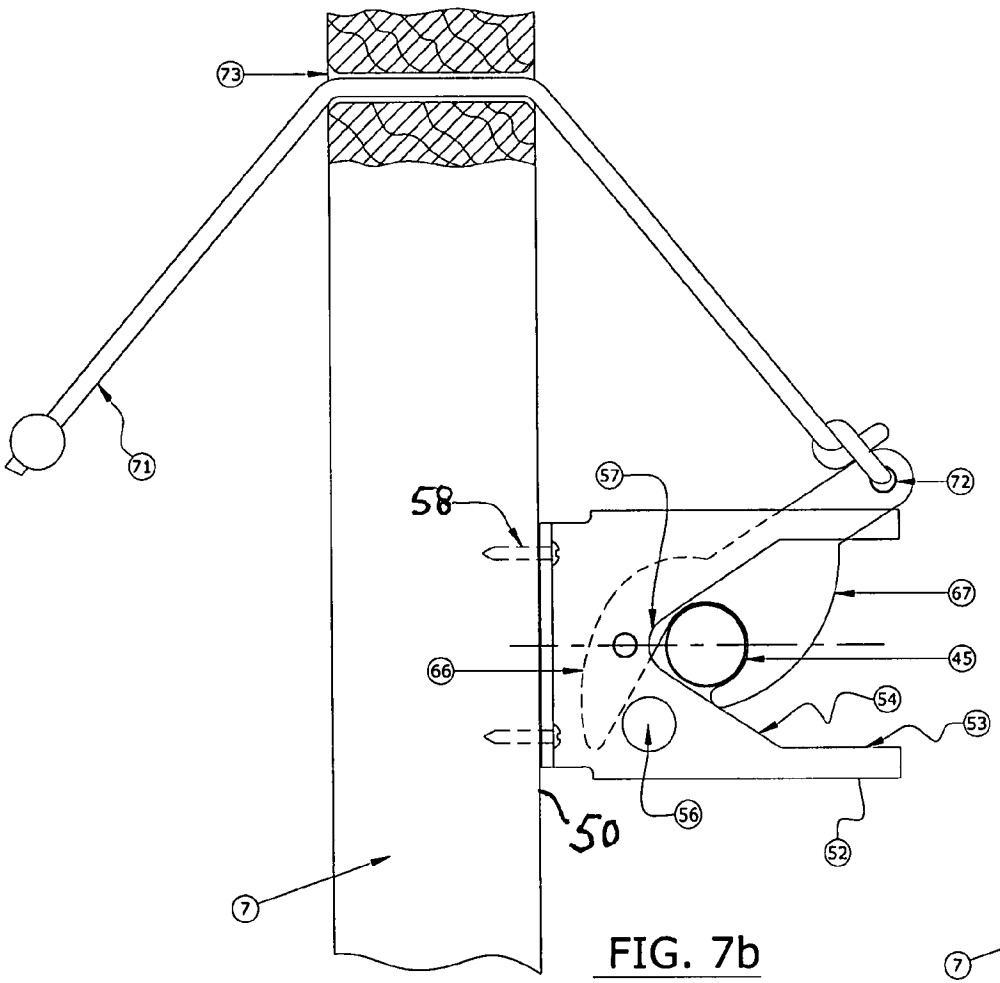
FIG. 7b
FIG. 7

GATE LATCH

BACKGROUND OF THE INVENTION

1. Field of Invention

The present invention relates to a gate latch for a swingable gate.

2. Background

A gate latch is used for maintaining a swingable member in a closed condition. The swingable member may be a swinging door or gate that is hingedly attached to a relatively fixed member, such as a frame or post. Once latched, the swingable member remains in latched condition until it is manually released.

Automatic gate latches enable automatic latching of the gate latch into a catch member on the fixed post when the swingable member is pivoted about its hinges to a closed position. Such automatic gate latches typically include a latching bar fixed to the swingable member such that it projects beyond its non-hinged edge. The catch member, which is provided on the fixed member, has an outwardly divergent opening positioned to receive the latching bar within its opening, when the swingable member is moved towards the closing position. The latching bar is automatically guided to the latching slot of the catch member, where a latching dog, pivotally provided on the catch member, rotates out of the way, then automatically falls by gravity onto the latching bar, thereby engaging and retaining the latching bar in latched position.

The latching bar that is fixed on the swingable member may become misaligned with the divergent receiving portion of the catch member that is mounted on the fixed post of the gate, due to sagging of the swingable member. Due to such misalignment, latching may not take place as the swingable member approaches the closed position, thereby making the gate latch non-operational. Any attempt to forcibly align the latching bar with the divergent receiving portion of the catch member by physically lifting the gate by hinges, may stress the hinges as well as the latching bar. Further, in the event of such a misalignment, the latching bar may hit against the catch member during closing of the gate and may cause damage to it, particularly when the swingable member is slammed shut.

U.S. Pat. No. 3,266,831 discloses an automatic gate latch in which the latching bar is pivotally provided over a mounting bracket and extends through a slot in a flange provided on the edge of the mounting bracket. The latching bar is rotatable around a screw, which attaches the latching bar to the bracket at a pivot, by an angle from substantially horizontal to substantially above the horizontal. The pivotal arrangement may provide sufficient latitude for the latching bar to be positioned within the outwardly divergent opening of the catch member, even when there is misalignment between the latching bar and the catch member, due to sagging of the swingable member or the relatively fixed member. However, such an arrangement may put too much stress on the screw that holds the latching bar to the bracket, especially as the swinging member sags, or if too much force is exerted on the gate in the closed position. Failure of the screw causes the entire gate latch to fail.

SUMMARY OF THE INVENTION

Accordingly, it is an aspect of the present invention to provide an automatic gate latch with improved strength.

In an embodiment of the invention, a gate latch is provided. The gate latch includes a bracket that has flanges with a plurality of holes for receiving fasteners that enable the bracket to be mounted to a bracket mounting surface. The bracket further has a raised portion joined with the flanges and constructed and arranged to cooperate with the bracket mounting surface to define a space therebetween. The gate latch also includes a latch arm that has an end portion thereof pivotally joined with the raised portion and capable of limited pivotal movement relative to the bracket. The latch arm is constructed and arranged to be received in the space between the raised portion and the mounting surface when the bracket is secured to the mounting surface. The gate latch also includes a catch constructed and arranged to be mounted to a catch mounting surface adjacent to the bracket and the latch arm. The catch includes a latch arm receiving region and a movable lock. The receiving region is constructed and arranged to receive the latch arm, and the lock is constructed and arranged to releasably retain the latch arm in the receiving region.

In an embodiment, a method for mounting a gate latch is provided. The gate latch includes a bracket, a latch arm, and a catch. The method includes pivotally joining the latch arm and the bracket, mounting the bracket on a bracket mounting surface so that the latch arm is held within a latch arm receiving space between the bracket and the bracket mounting surface, and mounting the catch onto a catch mounting surface adjacent the bracket and the latch arm. The catch and the bracket are positioned on their respective mounting surfaces such that when the gate is moved to a closed position, the catch receives the latch arm and locks the latch arm thereto to securely hold the gate in the closed position.

BRIEF DESCRIPTION OF THE DRAWINGS

Embodiments of the invention will now be described, by way of example only, with reference to the accompanying schematic drawings in which corresponding reference symbols indicate corresponding parts, and in which:

FIG. 3*a* is a front view of a bracket of the gate latch of FIG. 2;

FIG. 3*b* is a left side view of the bracket of FIG. 3*a;*

FIG. 3*c* is a right side view of the bracket of FIG. 3*a;*

FIG. 3*d* is a bottom view of the bracket of FIG. 3*a;*

FIG. 5*a* is a left side view of a catch of the gate latch of FIG. 2;

FIG. 5*b* is a front view of the catch of FIG. 5*a;*

FIG. 5*c* is a bottom view of the catch of FIG. 5*a;*

FIG. 7*a* is a left side view of the gate latch of FIG. 2 in a partially closed condition; and FIG. 7*b* is a left side view of the gate latch of FIG. 2 in the closed position.

DETAILED DESCRIPTION

Figure 1:
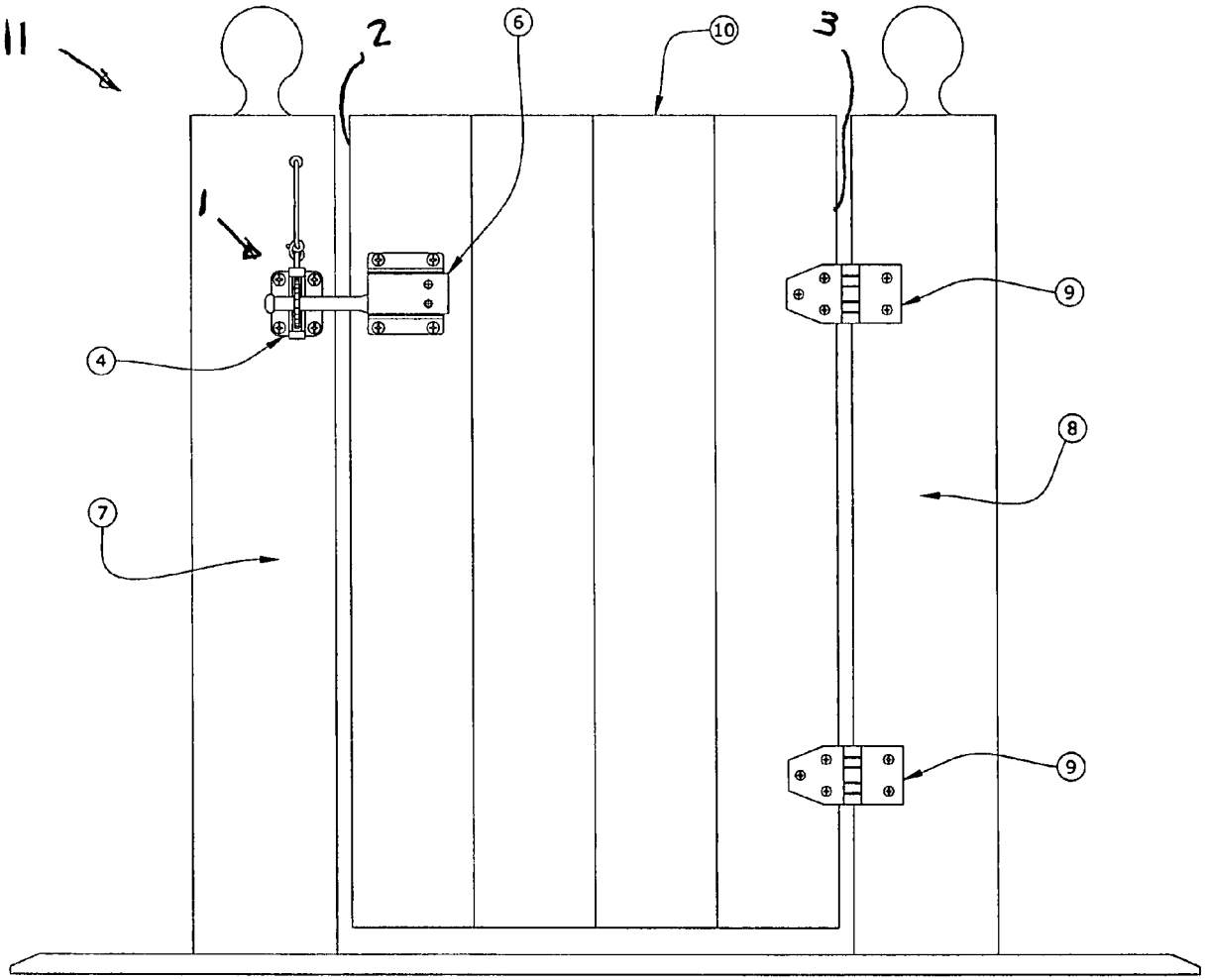
FIG. 1 is a front elevational view of a gate employing a gate latch of the present invention.

FIG. 1 illustrates the use of a gate latch 1 of the present invention. One part of the gate latch 1, which includes a bracket 6, is mounted adjacent to a free edge 2 opposite to a hinged edge 3 of a swingable member 10 of a gate 11. The swingable member 10 is swingably supported by hinges 9 secured to a first gate post 8. The other part of the gate latch 1, which includes a catch 4, is mounted on a second gate post 7.

Figure 2:
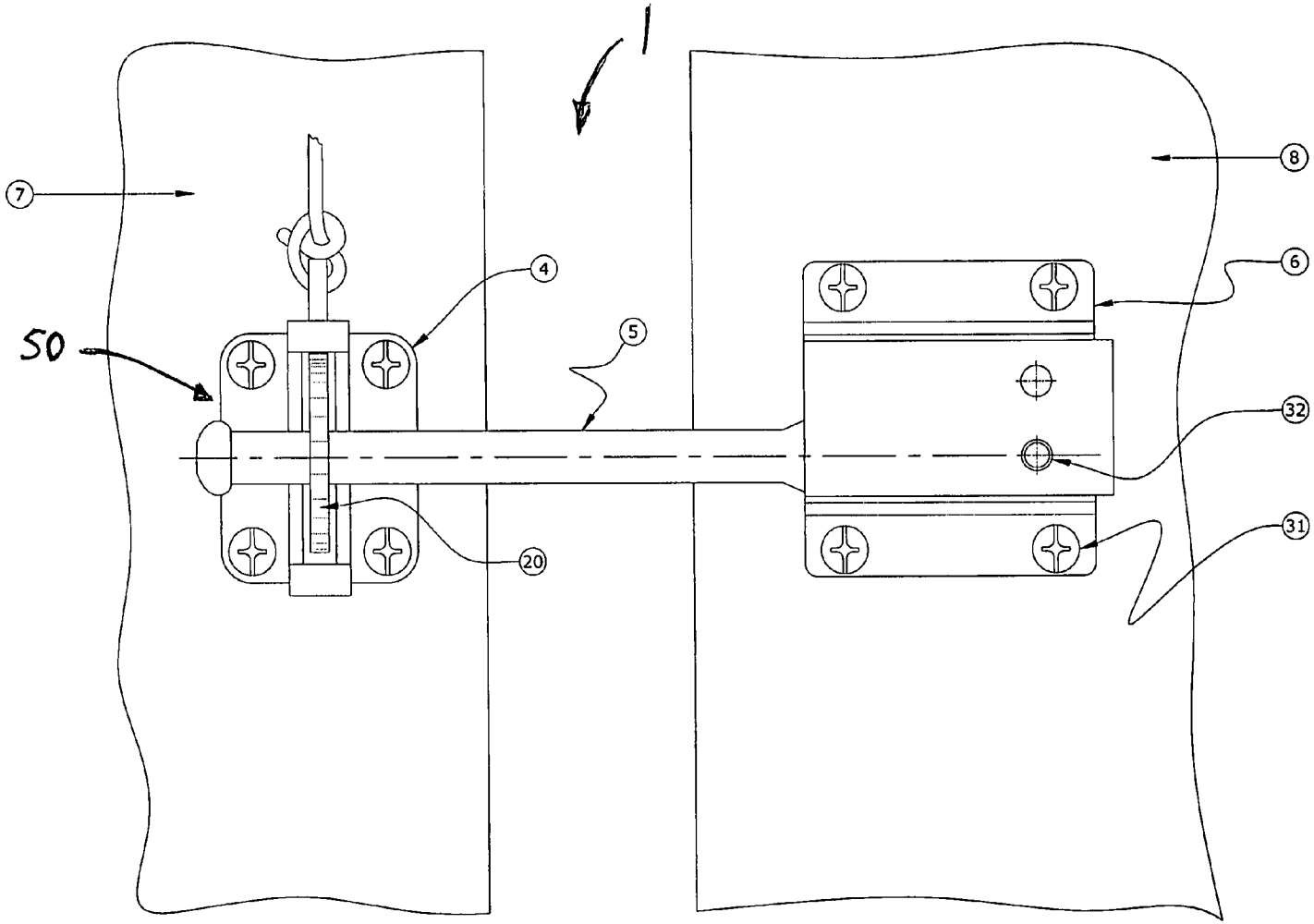
FIG. 2 is a detailed view of the gate latch of FIG. 1 in a closed position.

Referring to FIG. 2, the gate latch 1 includes the bracket 6, a latch arm 5, and the catch 4. The catch 4 has a latch lock 20, which may be pivotally mounted to the rest of the catch 4 by a fastener extending through the two sides of the catch 4. The latch lock 20 is pivotally provided within a recess between the two sides of the catch 4, which is discussed in further detail below, where it is angularly movable around the pivot.

Referring to FIGS. 3*a*-3*d*, the bracket 6 has a pair of flanges 35 on each side. Each flange 35 has a plurality of holes 31 for receiving fasteners for fixing the bracket 6 onto a bracket mounting 12 surface, on the swingable member 10. As shown in FIG. 3*b*, the bracket 6 has a raised portion 33 joined with flanges 35 on either side. The raised portion 33 is constructed and arranged to co-operate with the bracket mounting surface 12 to define a space 13 between the raised portion 33 of the bracket 6 and the bracket mounting surface 12. In the embodiment illustrated, one end of the raised portion 33 is open, and the other end of the bracket 6 is substantially closed by an end flange 36. In another embodiment, not shown, both ends of the bracket 6 are open. The bracket 6 is preferably made from a single sheet of metal that has been bent to define the flanges 35, raised portion 33, and the end flange 36.

As shown in the Figures, two pivot holes 32 are provided in the raised portion 33 of the bracket 6. The arrangement of the two pivot holes 32 enable the gate latch 1 to be mounted in either a left-handed configuration or a right-handed configuration. In the left-handed configuration, the catch 4 is mounted on the left hand side of the bracket 6, as shown in FIG. 2, and the latch arm 5 is operatively connected to the bracket 6 by inserting the protrusion 46 of the latch arm 5 through the lower of the two pivot holes 32. In this position, the latch arm 5 is substantially horizontal, but may rotate through a limited range of positions. Similarly, in the right-handed configuration, the catch 4 is mounted on the right side of the bracket 6 and the latch arm 5 is operatively connected to the bracket 6 by inserting the protrusion 46 through the other hole 32, which is now the lower hole. In this position, the latch arm 5 is substantially horizontal, but may rotate through a limited range of positions. Thus, the positioning of the pivot holes 32 is such that in either of the left-handed configuration or the right-handed configuration, the latch arm 5 is in a substantially horizontal position when it received by the corresponding lower pivot hole 32.

It is contemplated that instead of the pivot holes being provided in the raised portion 33 of the bracket 6, a pivot hole may be provided on the latch arm 5, and a pair of protrusions may be provided on the raised portion 33 of the bracket 6. The illustrated embodiment is not intended to be limiting in any way.

Figure 4:
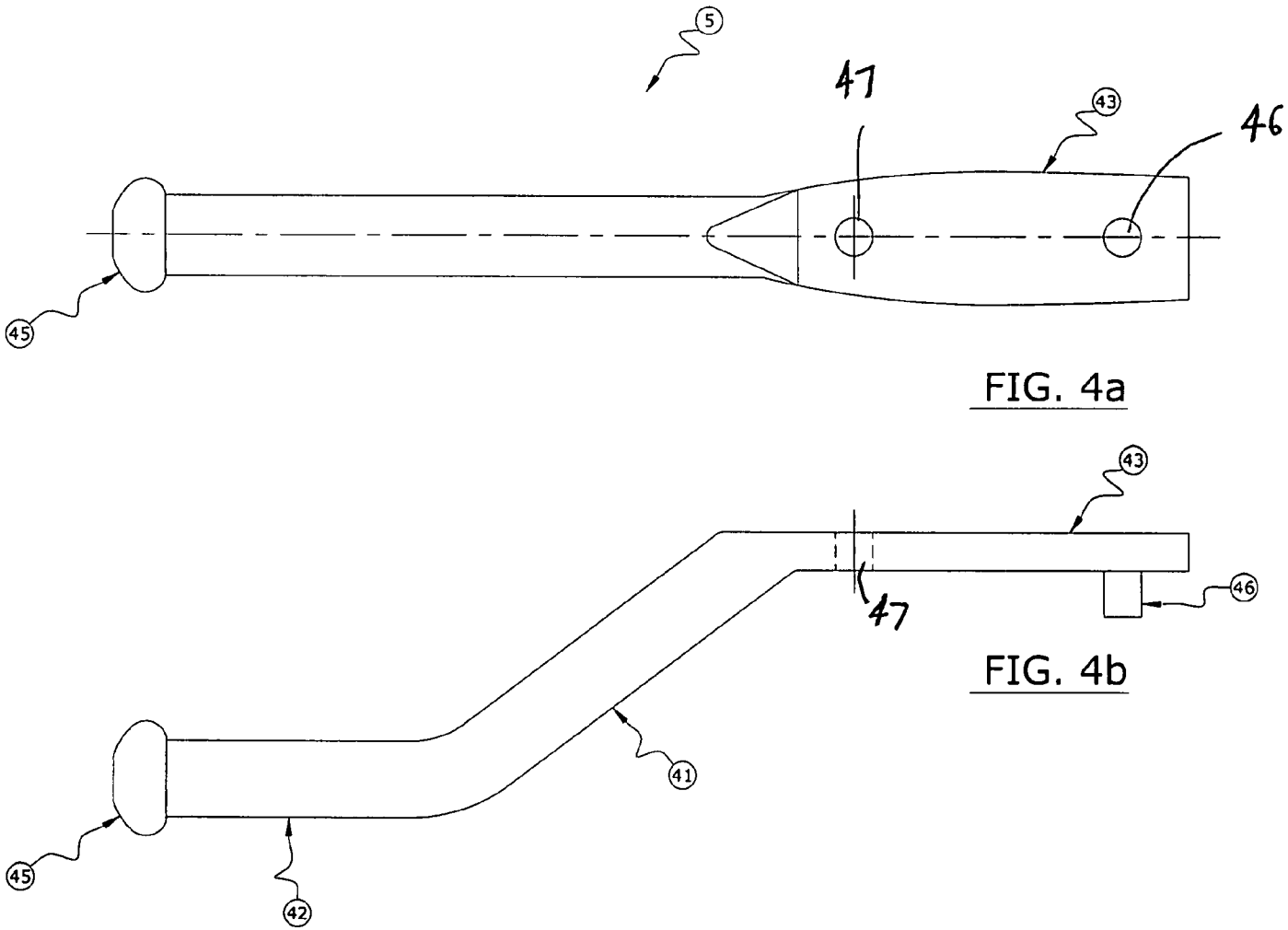
FIG. 4*a* is front view of a latch arm of the gate latch of FIG. 2.
FIG. 4*b* is a top view of the latch arm of FIG. 4*a;*

Referring to FIGS. 4*a* and 4*b*, the latch arm 5 has a head 45 at an end opposite the protrusion 46, an inclined portion 41, a first straight portion 42 and a second straight portion 43 that is offset with the first straight portion 42. As shown, the first straight portion 42 has a cylindrical shape. When the latch arm 5 is operatively connected to the bracket 6 and the bracket 6 is mounted to the mounting surface 12, the first straight portion 42 extends outwardly through the opening between the bracket mounting surface 12 and the raised portion 33 of the bracket 6. This allows the first straight portion 42 to interact with the catch 4, as will be described in greater detail below.

Preferably, the diameter of the cylindrical portion 42 is substantially the same as the diameter of the semi-circular notch 57 (FIG. 5*a*) of the catch 4 and is also substantially the same as the diameter of the circular notch 63 (FIG. 5*a*) of the latch lock 20 so that in a latched condition, the latch arm 5 is firmly held within the substantially circular latching slot 55. Such a dimensional alignment of the latch arm with the dimensions of the latching slot 55 leaves no gap for any prying tool to be inserted to pry open the gate latch when it is locked by the application of padlock through the opening 56 of the catch 4. The dimensions of the head 45 are larger than the dimensions of the latching slot 55 so that it may be easily grasped by the user, if desired, and used as a handle.

As shown in FIG. 4*b*, the second straight portion 43 has a flattened horizontal surface of a substantially rectangular shape. The protrusion 46, described above, extends from the second straight portion 43. A hole 47 may also be provided on the second straight portion 43. The hole 47 may receive a fastener, such as a screw, for applications in which the user would like to fix the latch arm 5 such that the latch arm 5 cannot pivot relative to the bracket 6. When the protrusion 46 is inserted into lower of the pivoting holes 32, the lower edge of the second straight portion 43 rests against the lower inner surface of the raised portion 33 of the bracket 6, and the latch arm 5 is substantially in the horizontal position. In such pivoted position, the length of the second straight portion 43 is such that it remains substantially housed within the bracket 6, and the inclined portion 41 and the first straight portion 42 extend outwardly from the recess between the raised portion 33 of the bracket 6 and the bracket mounting surface 12. The pivoting movement of the second straight portion 43 and therefore of the latch arm 5, is limited between the lower and the upper inner surfaces of the raised portion 33, which are created by the flanges 35. The latch arm 5 is positioned so that when the swingable member 8 on which mounting bracket 6 is attached is moved to a closed position, the first straight portion 42 of the latch arm enters the outwardly divergent opening of the catch 4 and is automatically engaged by the latch lock 20 via camming action.

Figure 6:
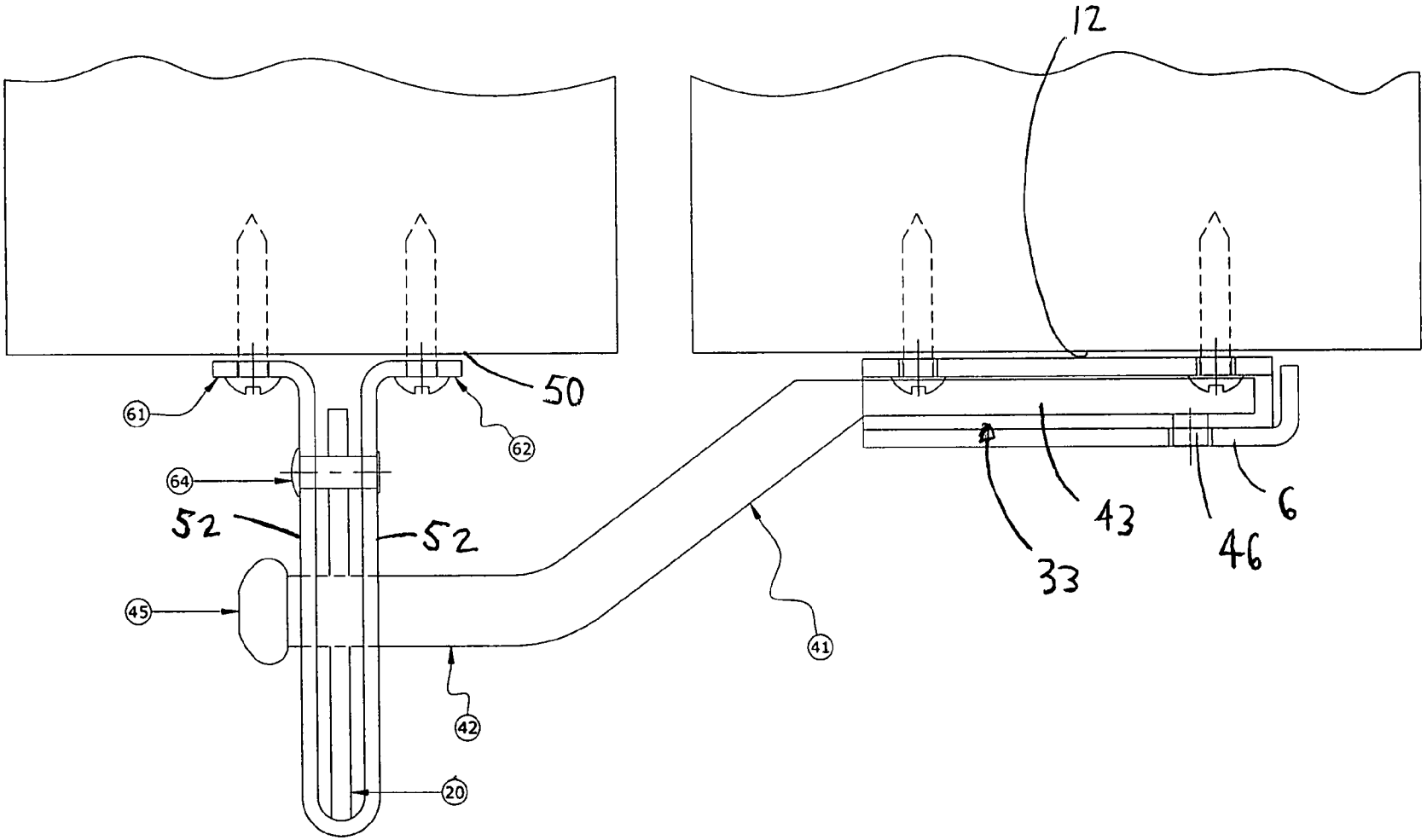
FIG. 6 is a partial top view of the gate latch of FIG. 2.

Referring to FIG. 5 and FIG. 6, the catch 4 is formed of two flat base portions 61, 62 (best seen in FIG. 6), which are secured to the second fixed member 7 of the gate by securing fasteners through a plurality of holes 51. Each of two flat base portions 61, 62 is integrally joined to substantially V-shaped side members 52 having a divergent opening to receive the latch arm 5 when the gate is closed. The two side members 52 extend outwardly from the plane containing the base portions 61, 62 and are integrally joined to each other at the terminal end 70, thereby forming a U-shaped recess 68 between the front and rear side members 52. Each of the V-shaped side members 52 has a substantial horizontal part 53, an outwardly divergent part 54 and a substantially semi-circular part 57 at its terminal end.

The latch lock 20 is pivotally mounted within the recess 68 by means of a fastener 64 extending through the two side members 52. In the illustrated embodiment, the fastener 64 is a rivet. However, this is not intended to be limiting in any way. For example, the fastener 64 may be a screw, or a nut and bolt. The latch lock 20 is rotatable about the fastener 64 within the recess 68. The latch lock 20 has a substantial circular notch 63 beyond the fastener 64, which forms a latching slot 55. The catch 4 is so positioned that when the swingable member 10 of the gate is moved to the closed position, the latch arm 5 is first received over the horizontal part 53 and is then guided upwards by the divergent camming part 54. It then strikes against the camming surface 67 of the latch lock 20, thereby causing the latch lock 20 to be lifted upwards, which in turn enables the latch arm 5 to move into the substantially semi-circular notch 57. The latch lock 20 then falls by gravity over the latch arm 5, thereby latching the latch arm 5 in the latching slot 55. As the diameter of the circular notch 63 substantially matches the diameter of the latching part 42 of the latch arm 5, the latch lock 20 firmly retains the latch arm 5 in the latched position. The latch lock 20 remains in latched position until it is manually disengaged.

The latch lock 20 includes a finger shaped handle 69 by which it may be grasped and moved upward to disengage the latch arm 5. In the latched position, the lower edge 66 of the latch lock 20 is just outside the hole 56 in the side arm 52 so that a padlock of any desired size may be passed through the hole 56, which will then lock the latch arm 5 in the latched position and prevent manual disengagement of the latch arm 5, until the padlock is removed.

Referring to FIGS. 7*a* and 7*b*, the gate latch 1 may be unlatched from other side of the gate by an activating cord or wire 71 tied through hole 72 of the handle 69 of the latch lock 20. The activating cord 71 extends through an opening 73 in the gate post 7. The other end of activating rod 71 extends to the interior side of the gate post 7 so that by pulling the anchor cord 71, the handle 69 of the latch lock 20 may be moved up and the latch arm 5 may be disengaged from the catch 4.

For installation of the gate latch 1 on the gate 11, the latch arm 5 is first pivotally joined with the mounting bracket 6 by inserting the protrusion 46 of the latch arm 5 into the lower pivoting hole 32 of the bracket 6. The bracket 6 is then mounted over the bracket mounting surface 12 located on the swingable member 10 by inserting of fasteners through holes 31 in the two flanges 35. The catch 4 is mounted on the catch mounting surface 50 located on the gate post 7 by inserting fasteners 58 through the holes 51 in the two flat base portions 61, 62 of the catch 4. The catch 4 is positioned such that when the gate is closed, the latch arm 5 is received on the horizontal part 53 of the V-shaped portion 52 or the catch 4, and the latch arm 5 remains substantially in a horizontal position. The catch 4 is mounted in such a way that it's two V-shaped side members 52 project outwardly of the plane of the catch mounting surface 50. Due to camming along the divergent portion 52, the latch arm 5 strikes against the camming surface 67 of the lock latching member 20, thereby causing the latch lock 20 to be lifted up and guiding the latch arm 5 into the latching slot 55. The latch lock 20 then falls by gravity over the latch arm 5 and retains the latch arm in the latched position within the substantially circular latching slot 55. The circular notch 63 of the latch lock matches with the circular surface of the latch arm and thus firmly grips and retains the latch arm in latched position. The latching thus may be fully automatic in the closing action.

The pivoting capability of the latch arm 5 allows for sufficient angular latitude to enable the latch arm 5 to be received in the divergent opening of V-shaped side member 52 of the catch 4, even when there is some misalignment between catch 4 and the latch arm 5, due to sagging of either the fixed member or the swingable member. Thus, the gate latch 1 still remains functionally effective and the possibility of misalignment is significantly reduced. The pivoting action of the latch arm 5 takes place within the space between the bracket mounting surface and the raised portion 33 of the bracket 6. Such an arrangement prevents transverse movement of the latch arm 5 in a direction normal to the plane in which it pivots.

The descriptions, above are intended to be illustrative, not limiting. Thus, it will be apparent to one skilled in the art that modifications may be made to the invention as described without departing from the scope of the claims set out below.

What is claimed is:

1. A gate latch comprising:

a bracket having flanges with a plurality of holes for receiving fasteners that enable the bracket to be mounted to a bracket mounting surface, said bracket further having a raised portion joined with said flanges and constructed and arranged to cooperate with said bracket mounting surface to define a space therebetween;

a latch arm having an end portion thereof pivotally joined with said raised portion and capable of limited pivotal movement relative to said bracket about an axis substantially perpendicular to said bracket mounting surface, said latch arm constructed and arranged to be received in said space between said raised portion and said mounting surface when said bracket is secured to said mounting surface, wherein said bracket and said latch arm are pivotally joined with a protrusion and a hole that receives the protrusion so that the end portion of the latch arm is fully supported by the bracket, the protrusion integrally formed on one of the latch arm and the raised portion of the bracket and the hole integrally formed on the other of the latch arm and the raised portion of the bracket; and a catch constructed and arranged to be mounted to a catch mounting surface adjacent to said bracket and said latch arm, said catch comprising a latch arm receiving region and a movable lock, said receiving region being constructed and arranged to receive said latch arm, and said lock being constructed and arranged to releasably retain the latch arm in said receiving region.

2. A gate latch according to claim 1, wherein said raised portion of said bracket comprises the hole and said latch arm comprises the protrusion.

3. A gate latch according to claim 2, wherein said raised portion of said bracket further comprises a second hole that is configured to receive the protrusion and located to allow the gate latch to be mounted in both a left-handed and a right-handed configuration.

4. A gate latch according to claim 1, wherein said raised portion of said bracket comprises the protrusion and said latch arm comprises the hole.

5. A gate latch according to claim 4, wherein said raised portion of said bracket further comprises a second protrusion that is located to allow the gate latch to be mounted in both a left-handed and a right-handed configuration.

6. A gate latch according to claim 1, wherein the pivotal movement of said latch arm relative to said bracket is limited by the flanges when said bracket is mounted to the bracket mounting surface.

7. A gate latch according to claim 1, wherein the pivotal movement allows for a predetermined amount of misalignment of the bracket relative to the catch.

8. A gate latch according to claim 1, wherein the bracket is made from a single sheet of metal that has been bent to define the flanges and the raised portion.

9. A method for mounting a gate latch, the gate latch comprising a bracket, a latch arm, and a catch, the method comprising:

pivotally joining the latch arm and the bracket by inserting a protrusion integrally formed on one of the latch arm and the bracket into a hole integrally formed on the other of the latch arm and bracket so that the latch arm is fully supported by the bracket;

mounting the bracket on a bracket mounting surface so that the latch, arm is held within a latch arm receiving space defined by the bracket and the bracket mounting surface so that the latch arm pivots about an axis substantially perpendicular to the bracket mounting surface; and mounting the catch onto a catch mounting surface, wherein the catch and the bracket are positioned on their respective mounting surfaces such that when the gate is moved to a closed position, the catch receives the latch arm and locks the latch arm thereto to securely hold the gate in the closed position.

10. A method according to claim 9, wherein the protrusion is located on the latch arm and the hole is located on the bracket.

11. A method according to claim 9, wherein the protrusion is located on the bracket and the hole is located on the latch arm.

12. A method according to claim 9, wherein the latch arm is held within the latch arm receiving space such that the latch arm is able to pivot with respect to the bracket after the bracket has been mounted to the bracket mounting surface.

* * * * *